United States Patent [19]

Ferguson et al.

[11] Patent Number: 4,683,868

[45] Date of Patent: Aug. 4, 1987

[54] WOOD BURNING STOVE HAVING GLASS CLEANING SYSTEM

[75] Inventors: Robert W. Ferguson, South Royalton; Derik K. Andors, Randolph, both of Vt.; E. Smith Reed, Jr., Hanover, N.H.

[73] Assignee: Vermont Castins, Inc., Randolph, Vt.

[21] Appl. No.: 849,739

[22] Filed: Apr. 9, 1986

[51] Int. Cl.[4] ..... F23M 7/00; F24C 15/04

[52] U.S. Cl. ..... 126/193; 126/83; 126/121; 110/179

[58] Field of Search ..... 126/193, 198, 200, 163 R, 126/152 B, 77, 76; 122/497, 498; 110/173 R, 174, 175 R, 179, 180, 182

[56] References Cited

U.S. PATENT DOCUMENTS

| | | | |
|---|---|---|---|
| 1,034,799 | 11/1932 | Hugy | 126/77 |
| 1,885,152 | 11/1932 | Stehl | 126/152 R |
| 1,911,394 | 5/1933 | Ritter | 110/179 |
| 1,974,373 | 9/1934 | Whitfield | 126/152 R |
| 2,114,772 | 4/1938 | Althoff | 126/77 |
| 2,465,559 | 3/1949 | Urban | 126/152 X |
| 2,481,165 | 9/1949 | Landry | 126/76 |
| 3,976,047 | 8/1976 | Breen et al. | 126/121 |
| 4,095,581 | 6/1978 | Billmeyer et al. | 126/121 |
| 4,180,051 | 12/1979 | Maier et al. | 126/193 |
| 4,214,569 | 7/1980 | Heine | 126/193 X |
| 4,214,570 | 7/1980 | Hansmeyer | 126/121 |
| 4,279,238 | 7/1981 | Syme | 126/77 |
| 4,368,722 | 1/1983 | Lynch | 126/77 |
| 4,404,953 | 9/1983 | Thulman et al. | 126/83 X |
| 4,461,273 | 7/1984 | Baker et al. | 126/77 |
| 4,466,358 | 8/1984 | Christian | 126/163 R |
| 4,487,195 | 12/1984 | Syme et al. | 126/77 |
| 4,520,791 | 6/1985 | Chamberlain | 126/198 X |

FOREIGN PATENT DOCUMENTS

| | | |
|---|---|---|
| 37281 | 3/1981 | European Pat. Off. . |
| 40100 | 6/1981 | European Pat. Off. . |
| 47996 | 8/1981 | European Pat. Off. . |
| 2056052 | 3/1961 | United Kingdom . |
| 1135646 | 12/1968 | United Kingdom . |
| 1590772 | 6/1981 | United Kingdom . |
| 2081884 | 2/1982 | United Kingdom . |

OTHER PUBLICATIONS

Hartex-Brochure, MCS Industries, Ltd., Guelph, Ontario.

"Catalytic Wood Stoves, Powell, Popular Science, pp. 77-78, Jan. 1982.

*Primary Examiner*—Larry Jones

*Attorney, Agent, or Firm*—Wolf, Greenfield & Sacks

[57] ABSTRACT

A wood stove with glass panels for viewing of the fire therein includes a glass cleaning system with a number of features which in combination effectively prevent soot and creosote buildup. A uniform curtain of hot air is directed downwardly over the glass panels to maintain the interior surface at an elevated temperature and form a barrier to prevent soot and creosote buildup on the glass panels. The curtain of hot air is supplied by a system of interior manifolds, including a first air reservoir manifold and a second manifold positioned above the glass panels for reducing turbulence and forming a uniform laminar curtain of air. Hot air is delivered symmetrically to the air reservoir manifold from side manifolds. In addition, the glass cleaning system includes dual pane glass to help maintain the glass interior at an elevated temperature and andirons to prevent the wood from blocking or deflecting the curtain of hot air. A deflector at the bottom of the glass panels redirects the curtain of hot air into the combustion region and causes vigorous burning which assists in elevating the temperature of the glass panels. A gas exit positioned high on the rear wall promotes smooth air flow across the glass panels and through the combustion region.

51 Claims, 6 Drawing Figures

WOOD BURNING STOVE HAVING GLASS CLEANING SYSTEM

FIELD OF THE INVENTION

This invention relates to wood burning stoves and, more particularly, to a wood burning stove provided with glass panels for viewing of the fire and a system for maintaining the glass panels in a clean, transparent condition.

BACKGROUND OF THE INVENTION

In recent years wood and coal burning stoves have gained widespread popularity as a means of home heating. These stoves operate efficiently and for long periods in a slow combustion mode. The joints of the stove are tightly sealed and air flow into the stove is carefully controlled. Such slow burning stoves provide high efficiency, but are subject to soot and creosote build-up in the stove itself and in the chimney or stovepipe.

Users frequently wish to be able to view the fire in a wood stove in a manner similar to an open fireplace. In order to control the air flow to the stove, it is necessary to provide transparent glass panels for viewing. During slow combustion in a wood stove, soot and creosote are deposited on all or parts of the transparent glass panels, thereby blocking the view of the fire. Once soot and creosote deposits occur, they are difficult to remove.

The transparent viewing panels are particularly difficult to keep clean when the stove is operated at low heat output. Wood stoves typically have a wide range of heat outputs, for example, 15,000–50,000 BTU per hour, but are customarily operated at low heat outputs to maintain comfortable temperatures for long periods while conserving fuel. Higher heat outputs are used during startup and during extremely cold weather conditions. Under high heat output conditions, operating temperatures are sufficiently high to prevent soot and creosote buildup on the glass panel interior. However, during low heat output conditions, stove surfaces are lower in temperature and deposit and condensation of soot and creosote on glass viewing panels are significant problems. It is desirable to provide a stove design wherein the transparent glass viewing panels will be kept uniformly clean and transparent throughout the life of the stove and over the range of operating conditions from low heat output to high heat output.

U.S. Pat. No. 4,461,273, Barker et al., discloses the use of incoming cool air directed downwardly over the transparent portion of the stove to reduce window temperature and resist staining and soot build-up thereon. U.S. Pat. No. 4,487,195, assigned to the assignee of the present invention, discloses a stove which utilizes air flow directed from each side and then upwardly across glass portions of a door to maintain those portions clean and unobscured. A gas exit from a primary combustion chamber is located relatively high on a rear wall of the chamber. European Patent Application No. 0047996 discloses a fireplace with glass doors utilizing laminar air flow of cool outside air from side channels across the inner surface of the glass doors. European Patent Application No. 0040100 discloses a stove with a viewing window wherein preheated air is delivered to the lower edge of the window. British Patent Application No. 2056052 discloses a heater provided with a viewing panel with openings at the top and bottom for flow of cool outside air across the inside of the viewing panel. A stove wherein outside air enters between dual pane glass doors is disclosed in *Popular Science,* Jan. 1982, p. 79. In general, such systems have not proven entirely satisfactory since soot and creosote build-ups still occur to some extent over portions of the glass window, particularly at low heat outputs.

It is a general object of the present invention to provide a heating apparatus with a glass panel which is maintained clean and transparent at all times.

It is another object of the present invention to provide a heating apparatus with a glass panel including means for supplying a curtain of hot air flowing uniformly and downwardly over the interior surface of the glass panel for elevating the glass temperature and forming a barrier to soot and creosote.

It is a further object of the present invention to provide a heating apparatus wherein a glass viewing panel is maintained clean over the entire range of heat outputs.

It is a further object of the present invention to provide a heating apparatus with a glass viewing panel and a system of internal manifolds for preheating of air, for removing turbulence and for directing a uniform curtain of hot air downwardly over the glass panel.

It is a further object of the present invention to provide a heating apparatus with glass viewing panels and a curtain of uniformly flowing air directed over the glass panels and then redirected into the combustion region such that combustion near the glass panels is maximized and such that radiation from the combustion region elevates the glass panel temperature.

It is a further object of the present invention to provide a wood burning stove with a transparent glass panel for viewing the fire, having a combination of the above-described features which combine effectively to minimize soot and creosote deposits on the glass panel.

SUMMARY OF THE INVENTION

According to the present invention, these and other objects and advantages are achieved in a heating apparatus for burning solid fuels comprising a frame assembly enclosing a combustion chamber, the frame assembly including generally vertical front, side and rear walls, a top and a bottom, a transparent glass panel mounted in the front wall to permit viewing of combustion in the combustion chamber, and a glass panel cleaning system which includes several unique features described below, each of which assists in maintaining a clean glass panel, and which combine in an effective and unique manner to prevent soot and creosote buildup on the glass panel and to maintain the glass panel in a clean, transparent condition.

In one unique feature of the present invention, the stove is provided with air flow means for supplying a curtain of hot air flowing uniformly and downwardly over the interior surface of the transparent glass panel for maintaining the glass panel at an elevated interior surface temperature and for forming a barrier so as to prevent soot and creosote buildup thereon. The air flow means comprises a double manifold arrangement positioned above the glass panels for reducing turbulence, and means for symmetrically supplying hot air to the double manifold arrangement. The double manifold arrangement includes a first air reservoir manifold positioned above the glass panel for providing a reservoir of low turbulence air and has an aperture which directs hot air downwardly. The double manifold arrangement further includes a second manifold positioned below the first manifold for receiving air from the first manifold and further reducing the turbulence of the air. The second manifold is provided with an exit slot for directing the curtain of hot air downwardly over the glass panel in a uniform and ideally laminar flow. The sizes and shapes of the first and second manifolds are important in achieving uniform and ideally laminar flow. The means for supplying hot air comprises side manifolds positioned on the interior of each of the side walls for heating of the external air flowing therethrough. The side manifolds are connected for symmetrical hot air flow to opposite ends of the first manifold. The effect of symmetrical hot air flow can also be achieved by introducing the hot air to the first manifold through any number of orifices so long as the orifices are positioned in a generally symmetrical manner with respect to the first manifold into which they flow.

In a further feature of the glass cleaning system of the present invention, the glass panel preferably comprises spaced apart panes of glass such that the interior surface of the glass panel is maintained at a high temperature to inhibit soot and creosote build-up. The glass panes are preferably spaced apart by a stiff wire form inside a tubular fiberglass gasket.

In a further unique feature of the glass cleaning system of the present invention, the apparatus is preferably provided with a containment means spaced inwardly from the glass panel for preventing solid fuel from blocking or deflecting the curtain of hot air flowing over the interior surface of the glass panel.

In a further unique feature of the glass cleaning system of the present invention, the interior surface of the glass panel is preferably positioned so that it is generally flush with the inner surface of the surrounding area and protrusions between the glass panel and the second manifold above the glass panel are kept at a minimum so as to prevent or minimize turbulence as air flows down from the second manifold toward and across the glass panel.

In a further feature of the glass cleaning system of the present invention, the apparatus is preferably provided with a grate on the bottom of the frame assembly for supporting the solid fuel during combustion and a deflector positioned below the glass panel for redirecting the downwardly flowing curtain of hot air to the base of a combustion region just above the grate for maximizing combustion adjacent the glass panel so as to assist in maintaining the interior surface of the glass panel at an elevated temperature.

In a further feature of the glass cleaning system of the present invention, the heating apparatus is preferably provided with a gas exit located relatively high on the rear wall of the combustion chamber to prevent it from being partially blocked by ash and charcoal buildup. The gas exit is positioned substantially symmetrically behind the glass panel. As a result, constant internal flow characteristics are maintained and turbulence which might affect the uniformity of the air curtain is prevented.

BRIEF DESCRIPTION OF THE DRAWINGS

For a better understanding of the present invention, together with other and further objects, advantages and capabilities thereof, reference may be had to the accompanying drawings which are incorporated by reference and in which.

DETAILED DESCRIPTION OF THE INVENTION

Figure 1:
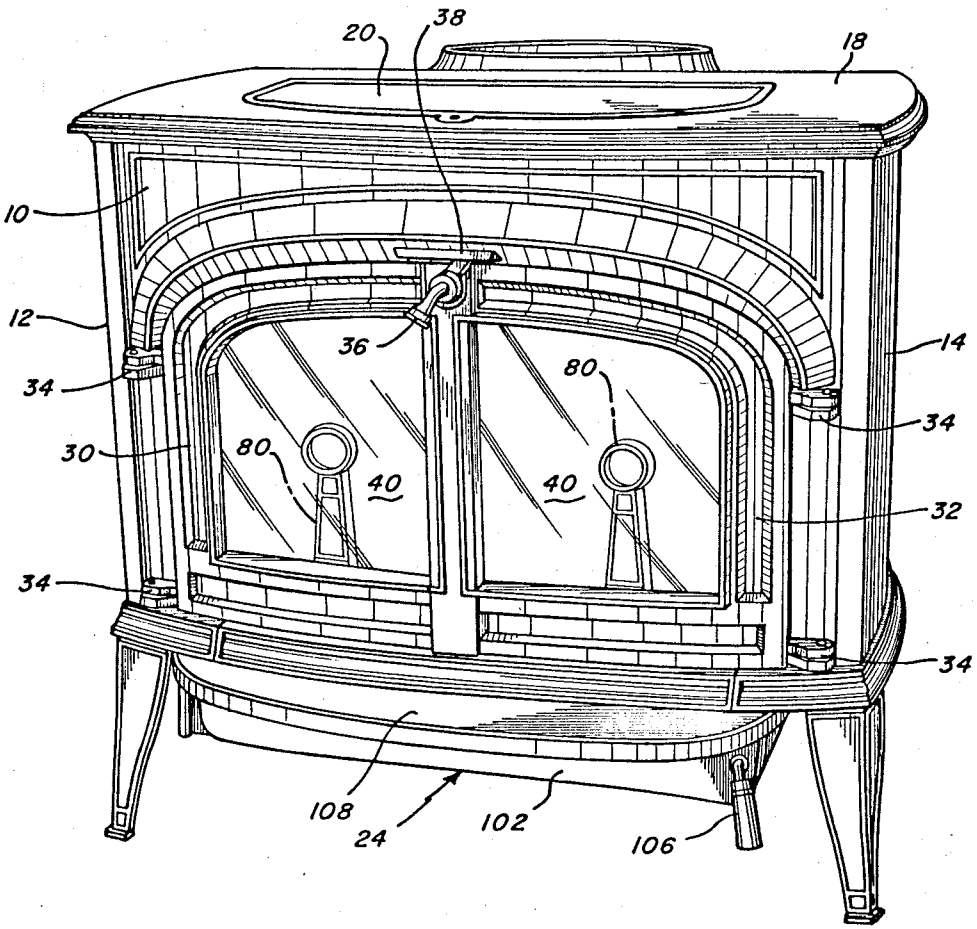
FIG. 1 is a perspective view of a wood burning stove in accordance with the present invention.

A wood stove in accordance with the present invention is shown in FIG. 1. The stove includes a generally vertical front wall 10, side walls 12 and 14 and a rear wall 16 (see FIG. 2). A top 18 of the frame assembly includes a removable griddle 20. A bottom 22 of the frame assembly may support an ash pan assembly 24 for receiving and storing ashes. The above-identified elements of the frame assembly define a combustion chamber where wood is burned.

The stove is provided with doors 30, 32 connected by hinges 34 to the front wall 10. The doors 30, 32 pivot outwardly from the stove about respective vertical axes through the hinges 34. In the closed position, the door 32 overlaps the door 30. A latching handle 36 engages a lip 38 on the front wall 10 to securely seal the doors 30, 32 in a closed position. Each of the doors 30, 32 is provided with a transparent glass panel 40 for viewing of the fire in the combustion chamber, while maintaining the frame assembly airtight. The glass panels 40 take up a relatively large portion of each door 30, 32 and are positioned relative to the combustion chamber to permit an aesthetically pleasing view of the fire therein. The number of doors and the number of glass panels and the number of plane surfaces these glass panels are secured in is not relevant to the present invention. The glass viewing panels can be mounted in one or several of the walls of the stove if desired. Further, the door or doors can be mounted for opening in any desired manner.

In accordance with the present invention, the stove is provided with a glass panel cleaning system for maintaining the glass panels 40 in a clean and transparent condition so as to permit viewing of the fire in the combustion chamber throughout the life of the stove. The glass panel cleaning system of the present invention overcomes the difficulty in maintaining clean glass in low heat output, slow combustion conditions. Thus, the stove can be operated over a wide range of heat outputs, typically 15,000 to 50,000 BTU per hour while maintaining clean glass.

The glass panel cleaning system includes several elements which act in combination to maintain clean glass and which will be discussed in detail hereinafter. A major element of the glass cleaning system is an arrangement for supplying a sheet, or curtain, of hot air flowing uniformly and downwardly over the interior surface of the transparent glass panels 40. The curtain of hot air is made highly uniform, and turbulence is prevented to the extent possible. The curtain of hot air has several functions. Clean air from the exterior of the stove is used. The clean air is relatively free of contaminants and, by its uniform flow, forms a barrier which prevents soot and creosote from reaching the glass panels 40. In addition, the clean air is heated to the greatest extent possible so that it will maintain the interior surfaces of the glass panels 40 at an elevated temperature, thereby inhibiting deposition and condensation of soot and creosote and tending to burn off any soot and creosote already present. The interior surfaces of the glass panels 40 should be maintained at a temperature sufficient to give a temperature measurement probe reading above 400° F. for optimum clean operation. Finally, the curtain of hot air is made as uniform and free of turbulence as possible to insure that the cleaning action occurs uniformly over the entire surface area of each glass panel 40. As a result, the glass panels are maintained clean and transparent over their entire surface area.

The uniform curtain of hot air is supplied by a system of manifolds fully described hereinafter. The glass panel cleaning system also includes dual pane glass panels for maintaining a high interior surface temperature and containment means, such as and irons or ribs, for preventing the wood in the fire from blocking or deflecting the curtain of hot air. The glass panel cleaning system further includes air redirection means at the bottom of the glass panels for redirecting the curtain of hot air into the base of the fire so as to promote maximum combustion near the glass panels, thereby maintaining elevated temperatures on the interior surfaces of the glass panels. In addition, there is provided a gas exit from the combustion chamber into either an exhaust flue pipe or a secondary burn chamber. The gas exit is positioned relatively high on the rear wall and is symmetrically located with respect to the glass panels 40 to prevent turbulence and to enhance uniform air flow across the glass panels, through the fire and then out through the gas exit. The stove can also include an optional removable ash pan below the wood grate for preventing ash buildup on the grate and facilitating ash removal.

A number of criteria must be taken into consideration when providing a stove with a glass cleaning system. Clearly, larger area glass panels are more difficult to keep clean, particularly at low heat outputs. However, it is desirable for aesthetic reasons to have large glass panels to permit viewing of a major portion of the flame region. The height of the glass is an important consideration, since the curtain of hot air flows downwardly over the glass panels. For glass panels with a large height dimension, it is difficult to maintain the uniformity of the air curtain, since the air has a tendency to break away from the glass toward the fire. It is preferred that the height of the glass panels be 50% to 80% of the height of the combustion chamber. The manifold system, in addition to providing a uniform curtain of hot air over the glass panels, must provide sufficient air flow to maintain maximum stove heat output and must have sufficient cross-section to allow expansion of the air as it is heated while passing through the manifold system. The position of the glass panels, relative to the flame region, is another important consideration in maintaining clean glass. It has been found that glass panels positioned relatively low on the front wall of the stove are kept clean more easily than glass panels positioned higher. Positioning the glass panels low on the front wall provides closer proximity to the hottest portion of the fire which results in more elevated temperatures due to radiation from the glowing coals. A combination of the curtain of hot air and radiant heat from the fire permits the glass to be kept clean.

The sheet, or curtain, of hot air which flows downwardly over the glass panels 40 is heated and directed in the desired manner by a system of manifolds internal to the stove. Referring now to FIGS. 2–5, there are shown cross-sectional views of the stove which clearly illustrate the system of manifolds. The manifold system includes a first air reservoir manifold 42 positioned on the interior of the front wall 10 above the doors 30, 32 and a second manifold 44 mounted near the top of each door 30, 32 adjacent to the tops of the glass panels 40. The manifold system further includes side manifolds 46, 48 positioned on the interiors of side walls 12, 14, respectively, bottom manifolds 50, 52 positioned along the bottoms of side manifolds 46, 48 and a rear manifold 53 positioned at the bottom rear of the stove. External air received through an outside air opening in rear manifold 53 travels through the passage defined by rear manifold 53, travels through the passages defined by bottom manifolds 50, 52 and then passes upward into passages enclosed by side manifolds 46, 48 where it is heated by the fire in the combustion chamber and by the hot walls of side manifolds 46, 48. The side manifolds 46, 48 contain conduits 56 at the top left and top right corners, respectively, of the stove for symmetrically delivering air into opposite ends of the first air reservoir manifold 42. Turbulence is largely removed from the air in expansion region 60 of first manifold 42, which has an elongated aperture 62 in its lower portion for delivering air through the top of the second manifold 44. Turbulence is further reduced in expansion region 64 of second manifold 44 and then delivered through an elongated exit slot 54 in a uniform sheet, or curtain, downwardly over the interior of the glass panels 40. The exit slot 54 extends across the top of the glass panels 40 and should have relatively uniform width to insure uniform air flow across glass panels 40.

The first air reservoir manifold 42 in combination with front wall 10 defines expansion region 60 and aperture 62, which restricts air flow from expansion region 60. The first manifold 42 extends with substantially symmetrical and ideally uniform cross-section across the top of the front wall 10. Preferably, the second manifold 44 is mounted on the doors 30, 32 above the glass panels 40. However, the second manifold can also be mounted on the front wall 10 directly above the doors 30, 32. Also, in cases where the glass panel is mounted in a wall of the stove rather than in a door, the second manifold 44 is mounted on the wall above the glass panel. The second manifold 44 in combination with doors 30, 32 or front wall 10 defines an expansion region 64 and the exit slot 54. Air is supplied to the top of the manifold 44 through the aperture 62 in the first manifold 42 and then passes out through the slot 54. The first manifold 42 has a relatively large volume, for example, 150 cubic inches, and creates a reservoir of low turbulence air which helps to insure the uniformity of the curtain of air delivered downwardly across the glass panels 40. The second manifold 44 has a smaller volume, for example 30 cubic inches, and further reduces turbulence before the curtain of air is supplied through the exit slot 54. The ratio of the volume enclosed by first manifold 42 to the volume enclosed by the second manifold 44 is preferably in the range of 3:1 to 6:1. Furthermore, the ratio of the volume enclosed by the first manifold 42 to the surface area of the glass panels 40 is preferably in the range between 0.50 $in^3/in^2$ and 2.50 $in^3/in^2$.

It has been found that the design of the manifold system which delivers the curtain of air downwardly over the glass panels 40 is important in achieving a uniform air flow. In particular, a double manifold system comprising air reservoir manifold 42 and second manifold 44 is positioned above the top of the glass panels 40. The air reservoir manifold 42 should have a larger volume than the second manifold 44 with an air flow restriction therebetween. The single most important factor in manifold design is the ratio of the volume of the expansion region 60 within first manifold 42 to the cross-sectional area of the exit slot 54 which directs the curtain of hot air over the glass panels 40. This ratio should be 10 $in^3$:1 $in^2$ or greater and is preferably 20 $in^3$;1 $in^2$. This ratio allows for adequate straightening of the air flow prior to delivery to the surface of the glass panels 40 and is essential for establishing and maintaining a uniform curtain of air. It is desired to provide laminar rather than turbulent air flow characteristics.

It has been found that the glass cleaning system works best when the slot 54 through which the air exits from the second manifold 44 is defined by the inner surface of glass pane 76 and a downwardly extending flange 54A which is contiguous with the wall of manifold 44. This flange 54A should be parallel with or tapered toward the pane 76 at its lower edge to form a narrow constricting exit for the air flowing from the second manifold 44. If tapered, the taper preferably does not exceed 20°. It is preferred that the exit slot 54 be one-quarter to five-eights inch deep from the interior surface of the glass panel 40 and one-half to two inches longer than the width dimension of the glass panels 40. The second manifold 44 has a substantially uniform cross-section in a direction across the tops of the glass panels 40.

The side manifold 46 in combination with side wall 12 defines an enclosed volume through which air passes and is heated. The side manifold 48 in combination with side wall 14 defines an enclosed volume through which air passes and is heated. Side manifolds 46, 48 are relatively thin and have a large area directly exposed to the heat of the primary fire in the combustion chamber where wood is burned, preferably covering more than 70% of the entire side walls 12, 14 area combined or more than 8% of the surface area of all walls directly exposed to the heat of the primary fire in the combustion chamber to promote the greatest possible heating of the air delivered to the first manifold 42. Air received through the passages of bottom manifolds 50, 52 passes upwardly through the passages of side manifolds 46, 48 on opposite sides of the stove and is delivered to the opposite ends of the first manifold 42. The effect of symmetrical hot air flow can also be achieved by introducing the hot air to the first manifold through any number of orifices so long as the orifices are positioned in a generally symmetrical manner with respect to the first manifold into which they flow. It has been found that symmetrical delivery of air to the first manifold 42 is critical in achieving a uniform curtain of air across the glass panels 40 in all operating conditions from very low fire to very high fire heat output conditions. Air is taken into the clean glass system from the exterior of the stove through the rear manifold 53 and is delivered substantially symmetrically to the passages of bottom air manifolds 50, 52. The air passing into the rear manifold 53 is carefully controlled by an adjustable opening to control the burn rate of the fire in the combustion chamber.

According to another aspect of the glass cleaning system, the glass panels 40 are each comprised of two glass panes 74, 76 separated by a space 78. The spaced-apart glass panes 74, 76 insulate the exterior from the interior of the stove so as to help maintain the interior surface of glass pane 76 at an elevated temperature. As described above, the elevated temperature of the glass surface inhibits soot and creosote condensation and deposition and aids in burning off any deposits which may have occurred. In a preferred construction, the glass panes 74, 76 are spaced apart by a stiff wire form inside a tubular fiberglass gasket positioned just inside the periphery of the glass panes 74, 76. This construction provides ease of assembly, uniformity of spacing between panes and long term stability of the gasket position.

The interior surfaces of the glass panels 40 are mounted generally flush with the inner surface of the surrounding area. In addition, protrusions (such as bolts or other hardware) between the glass panels 40 and the second manifold 44 above the glass panels 40 are kept at a minimum. These precautions prevent or minimize turbulence as air flows down from the second manifold 44 toward and across the glass panels 40.

According to yet another feature of the glass cleaning system of the present invention, the stove is provided with containment means, for example andirons 80, preferably extending upwardly from the bottom of the stove, or rearward from the front of the stove or doors, or positioned from the lower edge of the front of the stove or doors, in the combustion chamber and spaced behind each of the glass panels 40. The andirons 80 contain wood in the combustion region and prevent it from blocking or deflecting the curtain of air which cleans the glass panels 40. The andirons 80 can be pivoted at their lower ends or held in position by a socket or slot to permit removal, without the need for additional tools, from the front entrance to the stove in order to facilitate insertion of wood and tending of the fire. The andirons 80 can have any convenient shape and function simply to contain the burning wood in the combustion area and prevent it from interfering with the curtain of hot air. It is preferred that the wood be maintained at a spacing of $1\frac{1}{2}$ to $2\frac{1}{2}$ inches back from the interior surface of the glass panels 40. Logs are placed in the stove of the present invention generally parallel to the glass panels 40 to provide an aesthetically pleasing view of the fire which remains more or less constant as the logs burn down. This construction is in contrast to stoves which burn from front to back so that the visibly flaming region progressively moves away from the viewing window toward the rear of the stove.

Figure 2:
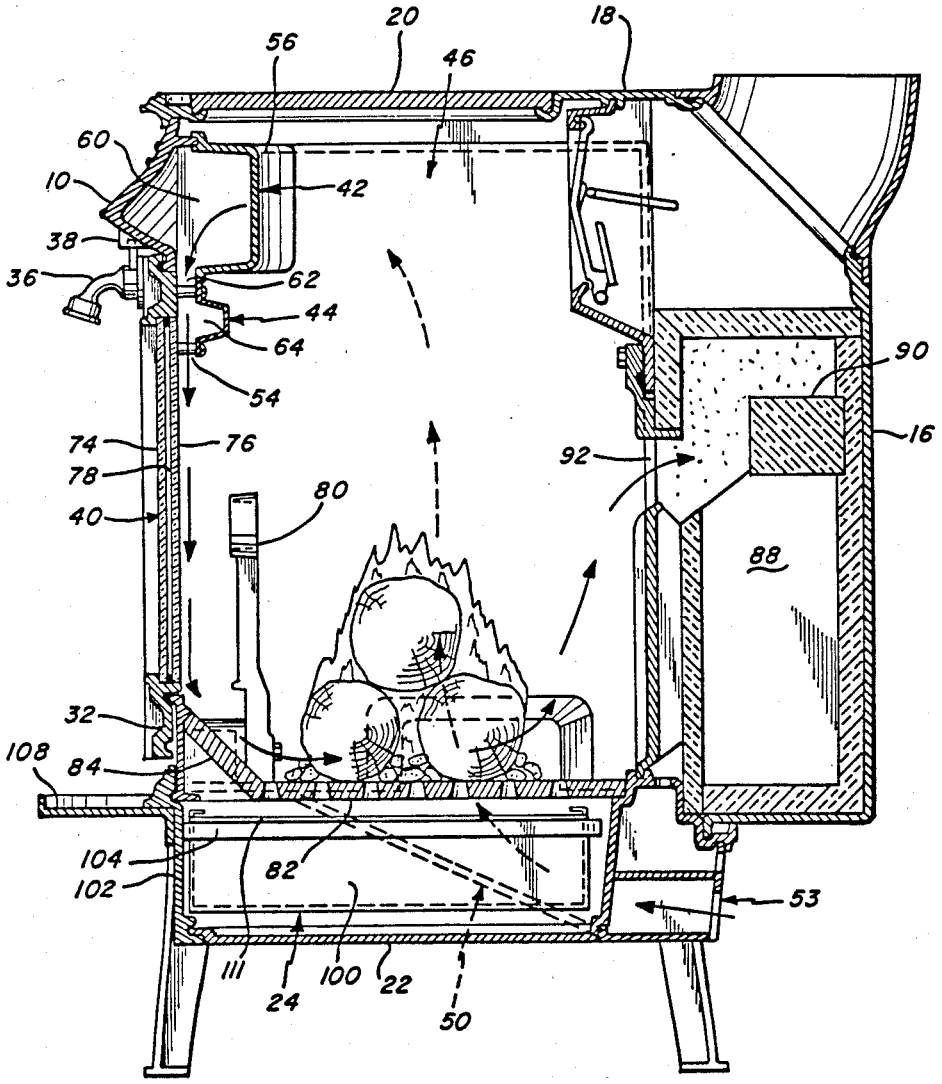
FIG. 2 is a cross-sectional side view of the wood burning stove shown in FIG. 1.
Figure 3:
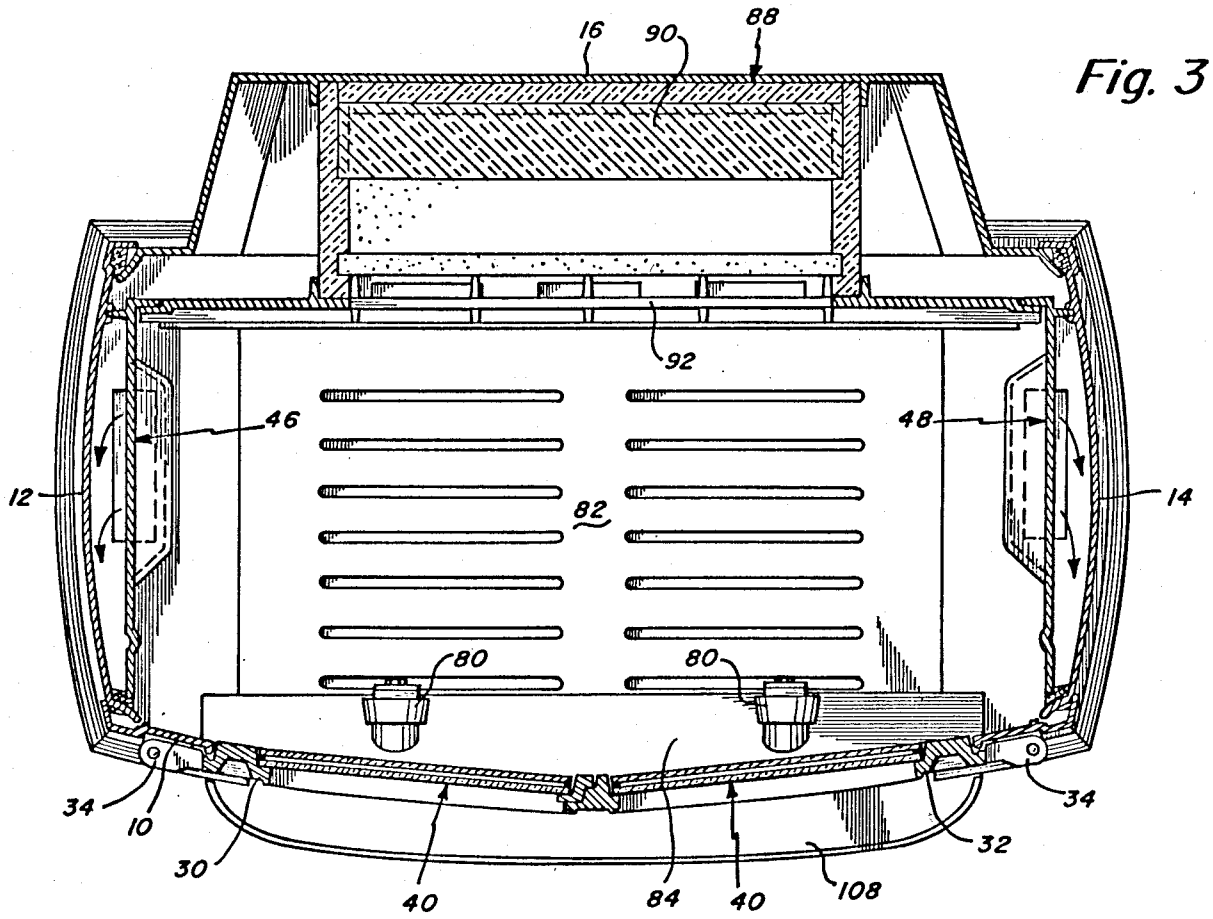
FIG. 3 is a cross-sectional top view through the middle portion of the wood burning stove shown in FIG. 1.

A wood grate 82 is mounted above the ash pan assembly 24. The wood grate 82 contains holes, slots or other perforations to permit ashes to drop into the ash pan. As shown in FIG. 2, the stove is provided with an air deflection element 84 mounted near the base of the doors 30, 32 and extending rearwardly at an angle to the doors 30, 32 toward the wood grate 82. The element 84 deflects, or redirects, the curtain of hot air, which flows downwardly across the glass panels 40, toward the base of the fire on the wood grate 82. The element 84 provides a smooth transition for air flow and minimizes turbulence at the base of the doors 30, 32. The redirected air flow causes the fire on the wood grate 82 to burn vigorously in a region close to the glass panels 40 and to provide maximum radiant heating of the glass panels 40. The radiant heating assists in maintaining the glass panels 40 at an elevated temperature and in preventing soot and creosote deposits. Furthermore, the fire is casued to burn vigorously in a region which is easily viewed through the glass panels 40.

Figure 4:
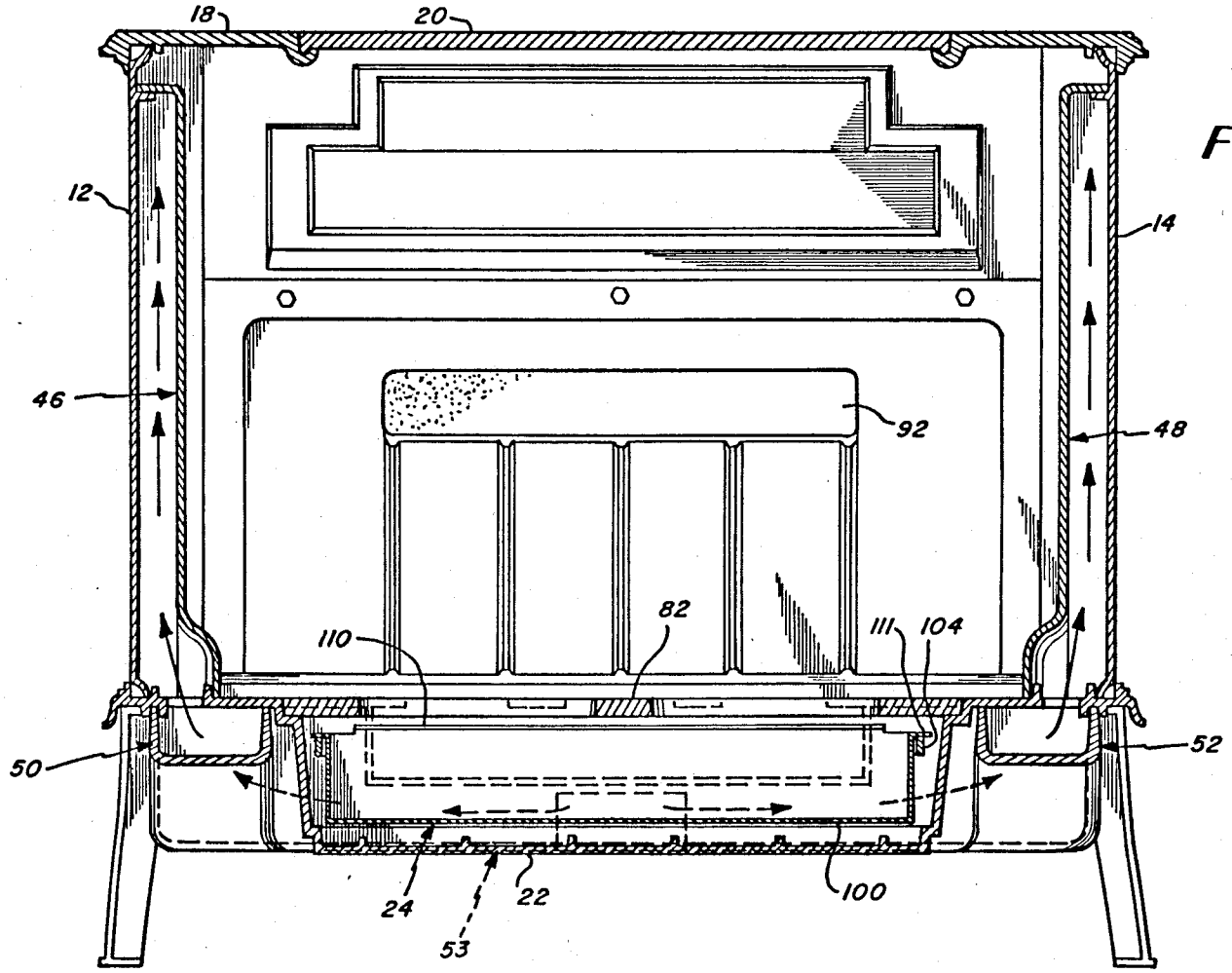
FIG. 4 is a cross-sectional front view of the wood burning stove shown in FIG. 1.
Figure 5:
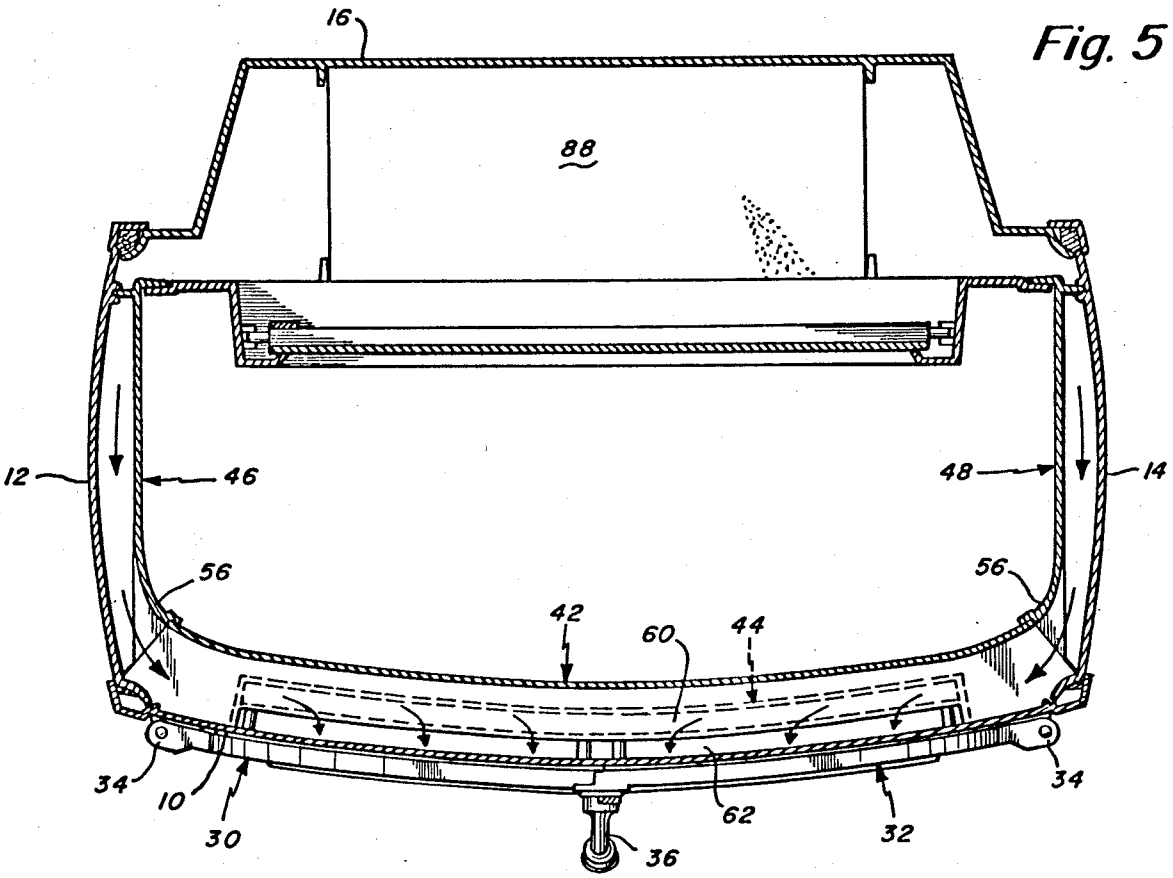
FIG. 5 is a cross-sectional top view through the upper portion of the stove shown in FIG. 1, illustrating the first air reservoir manifold.

Referring again to FIG. 2, the stove in accordance with the present invention includes a secondary combustion package 88 which can contain a catalytic element 90, if so desired, similar to that described in U.S. Pat. No. 4,510,918. The secondary combustion package 88 permits ignition of flue gases at relatively low temperatures. A gas exit 92 from the stove combustion chamber serves as an inlet to the combustion package 88. The gas exit 92 is located on the rear wall of the combustion chamber one-third of the distance, or higher, between the bottom and top of the wall, preferably about half to two-thirds of the way up the wall. The gas exit 92 is an elongated slot substantially centered on the rear of the combustion chamber and symmetrically positioned with respect to the glass panels 40, as seen in FIG. 4. It has been found that this location of the gas exit 92 provides for smooth, non-turbulent flow of air and exhaust gases through the manifold system, downwardly across the glass panels 40, into the front of and the base of the fire on the wood grate 82, and upwardly to the gas exit 92. The elevated position of the gas exit 92 prevents it from being partially blocked by ash and charcoal buildup. Therefore, the gases exit through a constant area orifice. As a result, constant internal flow characteristics are maintained and turbulence which might affect the uniformity of the air curtain is prevented.

Figure 6:
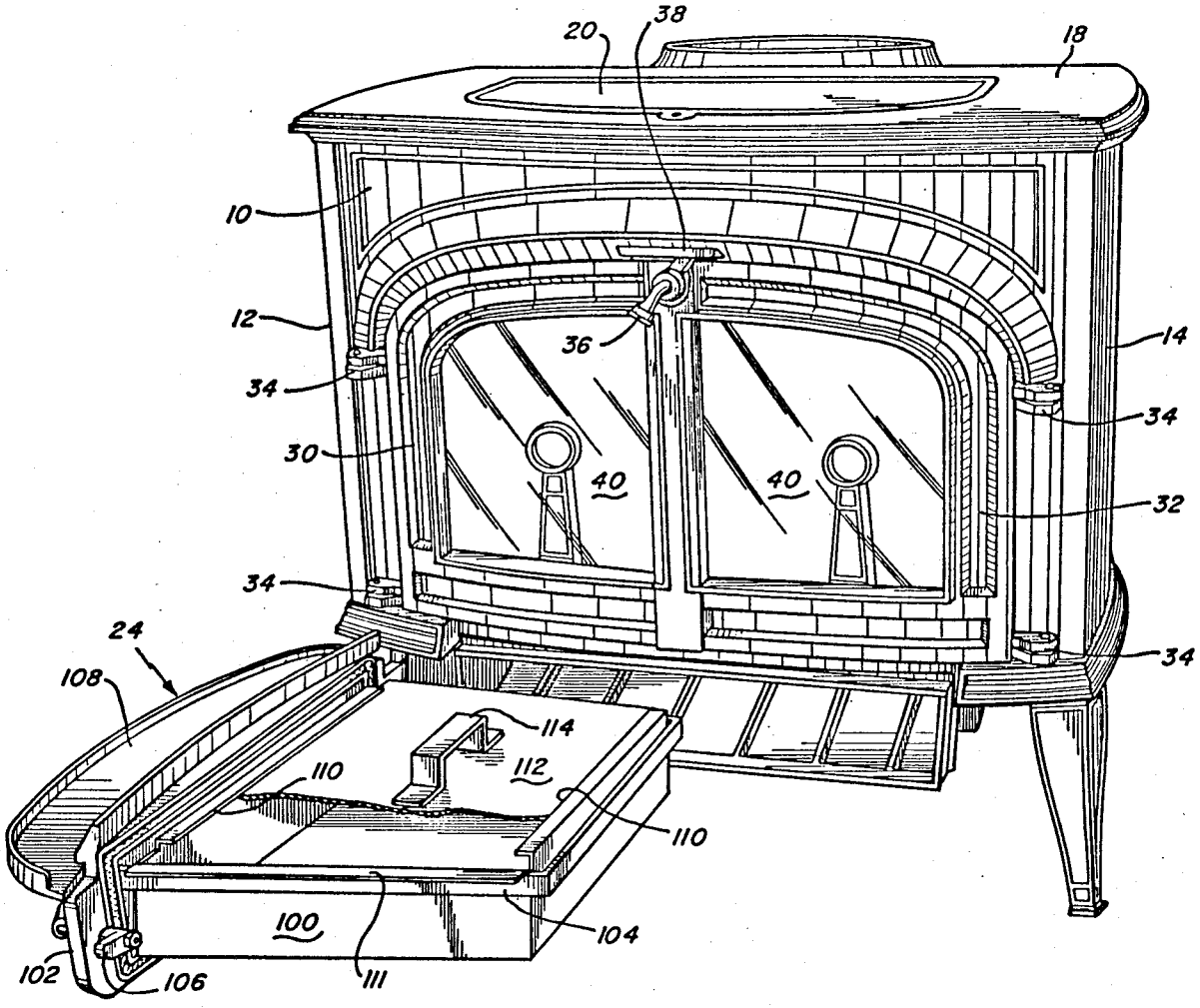
FIG. 6 is a perspective view of the wood burning stove of FIG. 1 with the ash pan assembly swung out.

The ash pan assembly 24 is shown in the open position in FIG. 6. An ash pan 100 is supported at the rear of a hinged ash removal door 102 by a mounting bracket 104. The door 102 is hinged at the left edge for pivoting around a vertical axis and includes a latch 106 for latching the door 102 in a closed position. The door 102 may be provided with an outwardly extending tray 108 to catch ashes and coals which accidentally fall out of the stove when the doors 30, 32 are opened. The ash pan 100 is in the form of a low profile, open-topped metal box having a trapezoidal shape to correspond with the shape of the combustion chamber and to facilitate opening of the door 102. It will be understood that the ash pan 100 can have any convenient shape, depending on the details of the stove construction. It will also be understood that the door may be attached to the stove by means other than a hinge, such as glides or slides or other means, which permit it to be pulled substantially away from the closed position but still attached to the stove.

The ash pan is provided at the tops of the front and rear sides with inwardly extending, overhanging ribs 110 which are used to retain an ash pan cover 112 shown in a fragmentary view in FIG. 6. The tops of the left and right sides are provided with outwardly extending, overhanging ribs 111 which rest on the mounting bracket 104. The ash pan cover 112 is a metal sheet provided with a handle 114. The cover 112 slides in the left side of the ash pan 100 under the overhanging ribs 110 and is dimensioned to cover the top of the ash pan 100 in a more or less airtight fashion. The ash pan 100 is then lifted out of the mounting bracket 104 by handle 114 for disposal of the ashes. The disclosed ash pan assembly 24 permits removal of ashes in a clean and safe manner. The ash pan 100 can be removed from the front of the stove without opening the main doors 30, 32 and without a need for a shovel.

While there has been shown and described what is at present considered the preferred embodiments of the invention, it will be obvious to those skilled in the art that various changes and modifications may be made therein without departing from the scope of the present invention as defined by the appended claims.

What is claimed is:

1. A heating apparatus for buring solid fuels comprising:

a frame assembly enclosing a combustion chamber, said frame assembly including front, side and rear walls, a top and a bottom;

a transparent glass panel mounted in one of said walls to permit viewing of combustion in the combustion chamber; and glass panel cleaning means for supplying a curtain of hot air flowing uniformly and downwardly over the interior surface of said transparent glass panel for maintaining said glass panel at an elevated interior temperature and for forming a barrier to prevent soot and creosote buildup thereon, said glass panel cleaning means including a first manifold for providing a reservoir of low turbulence air, said first manifold being positioned above said glass panel and having an aperture for directing hot air downwardly, means for supplying hot air to said first manifold, and a second manifold positioned below said first manifold, said second manifold receiving air from said aperture of said first manifold and further reducing the turbulence of said air, said second manifold being provided with an exit slot for directing said curtain of hot air downwardly over said glass panel.

2. A heating apparatus as defined in claim 1 wherein said transparent glass panel is mounted in a hinged door in said front wall.

3. A heating apparatus as defined in claim 1 wherein said aperture is elongated in a direction parallel to the surface of said glass panel and lies in a plane perpendicular to the surface of said glass panel.

4. A heating apparatus as defined in claim 1 wherein said exit slot of said second manifold is elongated in a direction parallel to the surface of said glass panel and is in a plane perpendicular to the surface of said glass panel.

5. A heating apparatus as defined in claim 1 wherein said second manifold is mounted on said hinged door adjacent the top of said glass panel.

6. A heating apparatus as defined in claim 1 wherein said second manifold is mounted on said front wall just above the top of said glass panel.

7. A heating apparatus as defined in claim 1 wherein said means for supplying hot air to said first manifold comprises side manifolds positioned on the interior of each of said side walls for heating of the air therein, said side manifolds being connected for symmetrical hot air flow to said first manifold.

8. A heating apparatus as defined in claim 7 wherein air is introduced into said side manifolds at the bottom thereof.

9. A heating apparatus as defined in claim 1 wherein said glass panel comprises two spaced-apart panes of glass which assist in maintaining the interior surface of said glass panel at a high temperature to prevent soot and creosote buildup.

10. A heating apparatus as defined in claim 9 wherein said glass panes are spaced apart by a stiff wire form inside a tubular fiberglass gasket positioned just inside the periphery of the glass panes.

11. A heating apparatus as defined in claim 9 wherein said glass panel is mounted with its interior surface substantially flush with the interior surface of the surrounding area.

12. A heating apparatus as defined in claim 9 wherein the region between said glass panel and said second manifold is substantially free of protrusions.

13. A heating apparatus as defined in claim 9 wherein said glass panel has a height in the range of 50% to 80% of the height of said combustion chamber.

14. A heating apparatus as defined in claim 1 further including containment means spaced inwardly from said glass panel for preventing said solid fuel from blocking or deflecting said curtain of hot air flowing over the interior surface of said glass panel.

15. A heating apparatus as defined in claim 14 wherein said containment means comprises a pair of andirons extending upwardly from the bottom of said frame assembly.

16. A heating apparatus as defined in claim 15 wherein said containment means keeps said solid fuel at least 1½ inches from said glass panel.

17. A heating apparatus as defined in claim 1 further including a grate on the bottom of said frame assembly for supporting said solid fuel during combustion, and means positioned below said glass panel for redirecting said downwardly flowing curtain of hot air rearwardly to the base of a combustion region just above said grate for maximizing combustion adjacent said glass panel so as to assist in maintaining the interior surface of said glass panel at an elevated temperature.

18. A heating apparatus as defined in claim 17 wherein said redirecting means comprises a deflector positioned angularly between the bottom of said glass panel and said grate and extending laterally across at least a major portion of said glass panel.

19. A heating apparatus as defined in claim 1 wherein said glass panel is maintained during normal combustion at a temperature sufficient to give a temperature measurement probe reading of at least 400° F.

20. A heating apparatus as defined in claim 1 further including gas exit means located at the rear of said combustion chamber opposite said glass panel and systematically located at one-third to two-thirds of the distance from the bottom to the top of said combustion chamber, said gas exit means insuring that air and gases smoothly exit the combustion chamber without creating turbulence which reduces the uniformity of said curtain of hot air.

21. A heating apparatus as defined in claim 20 wherein said gas exit means is located at one-half to two-thirds of the distance from the bottom to the top of said combustion chamber.

22. A heating apparatus for burning solid fuels comprising:

a frame assembly defining a combustion chamber, said frame assembly including front, side and rear walls, a top and a bottom;

a glass panel mounted in a portion of said frame assembly to permit viewing of combustion in the combustion chamber; and glass panel cleaning means for causing a curtain of hot air to flow uniformly downward over the interior surface of said glass panel for maintaining said glass panel at an elevated interior temperature and for forming a barrier to prevent soot and creosote buildup thereon, said glass panel cleaning means including a first manifold positioned above said glass panel for providing a reservoir of low turbulence air, said first manifold having an aperture for directing hot air downwardly, a second manifold positioned below said first manifold for receiving air from said aperture of said first manifold and further reducing the turbulence of said air, said second manifold being provided with an exit slot for directing said curtain of hot air downwardly over said glass panel, and means for symmetrically supplying hot air to said first manifold.

23. A heating apparatus as defined in claim 22 wherein said exit slot of said second manifold is elongated in a direction parallel to the surface of said glass panel and lies in a plane perpendicular to the surface of said glass panel.

24. A heating apparatus as defined in claim 23 wherein the cross-section of said first manifold is substantially uniform in a direction parallel to the surface of said glass panel.

25. A heating apparatus as defined in claim 23 wherein the dimension of said exit slot of said second manifold in a direction perpendicular to the surface of said glass panel is in the range between ¼ inch and ⅝ inch.

26. A heating apparatus as defined in claim 25 wherein said exit slot of said second manifold has a dimenion in a direction parallel to the surface of said glass panel of approximately ½ to 2 inches greater than the width of said glass panel to assure a uniform curtain of air to the edge of said glass panel.

27. A heating apparatus as defined in claim 24 wherein said second manifold has a cross-section which is substantially uniform in a direction parallel to the surface of said glass panel.

28. A heating apparatus as defined in claim 24 wherein said means for symmetrically supplying hot air to said first manifold comprises side manifolds positioned on the interior of each of said side walls for heating of the air therein, said side manifolds being connected for hot air flow to opposite ends of said first manifold.

29. A heating apparatus as defined in claim 28 wherein said side manifolds cover more than seventy percent of the entire surface area of each of said side walls.

30. A heating apparatus as defined in claim 28 wherein said side manifolds cover more than eight percent of the surface area of all walls directly exposed to the heat of the fire in the combustion chamber.

31. A heating apparatus as defined in claim 28 wherein air is introduced into said side manifolds near the bottom of said side walls.

32. A heating apparatus as defined in claim 27 wherein the exit slot of said second manifold is at least as long as the width of said glass panel.

33. A heating apparatus as defined in claim 22 wherein said frame assembly includes a hinged door, wherein said glass panel is mounted in said hinged door and wherein said second manifold is mounted on said hinged door adjacent the top of said glass panel.

34. A heating apparatus as defined in claim 22 wherein said first and second manifolds comprise a double manifold system extending across the front wall of said stove above said glass panels and wherein each manifold comprises an expansion volume and an output flow restrictor, the flow from the first manifold being supplied to the second manifold.

35. A heating apparatus as defined in claim 34 wherein the cross-section of said first manifold is larger than the cross-section of said second manifold.

36. A heating apparatus as defined in claim 35 wherein the ratio of the volume enclosed by the first manifold to the cross-sectional area of said exit slot of said second manifold is 10 $in^3$:1 $in^2$ or greater.

37. A heating apparatus as defined in claim 35 wherein the ratio of the volume enclosed by the first manifold to the cross-sectional area of the exit slot of the second manifold is about 20 $in^3$:1 $in^2$.

38. A heating apparatus as defined in claim 22 wherein the ratio of the volume enclosed by the first manifold to the volume enclosed by the second manifold is in the range of 3:1 to 6:1.

39. A heating apparatus as defined in claim 38 wherein said first manifold encloses a volume on the order of 150 cubic inches and said second manifold encloses a volume on the order of 30 cubic inches.

40. A heating apparatus as defined in claim 22 wherein the ratio of the volume enclosed by said first manifold to the surface area of said glass panel is in the range between 0.50 $in^3/in^2$ and 2.50 $in^3/in^2$.

41. A heating apparatus as defined in claim 22 wherein said exit slot of said second manifold is elongated in a direction parallel to the surface of said glass panel and is defined in part by a flange extending downwardly from said second manifold in a plane between one parallel to said glass panel and one at an angle of less than 20° thereto

42. A heating apparatus as defined in claim 22 wherein said means for symmetrically supplying hot air to said first manifold achieves said uniform curtain of hot air across said glass panel in all operating conditions from very low fire to very high fire heat output conditions.

43. A heating apparatus as defined in claim 22 wherein said glass panel includes dual glass panes spaced apart by a stiff wire form inside a tubular fiberglass gasket positioned just inside the periphery of the glass panes.

44. A heating apparauts as defined in claim 22 wherein said glass panel is mounted with its interior surface substantially flush with the interior surface of the surrounding area to minimize turbulence as air flows across the glass panel.

45. A heating apparatus as defined in claim 22 further including gas exit means located at the rear of said combustion chamber opposite said glass panel and systematically located at one-third to two-thirds of the distance from the bottom to the top of said combustion chamber, said gas exit means insuring that air and gases smoothy exit the combustion chamber without creating turbulence which reduces the uniformity of said curtain of hot air.

46. A heating apparatus as defined in claim 45 wherein said gas exit means is located at one-half to two-thirds of the distance from the bottom to the top of said combustion chamber.

47. A heating apparatus for burning solid fuels comprising:

a frame assembly defining a combustion chamber, said frame assembly including front, side and rear walls, a top and a bottom;

a hinged door mounted in one of said walls for pivoting about a vertical axis, said hinged door including a transparent glass panel to permit viewing of combustion in the combustion chamber; and glass panel cleaning means comprising air flow means for causing a curtain of hot air to flow uniformly downward over the interior surface of said transparent glass panel for maintaining said glass panel at an elevated interior temperature and for forming a barrier to prevent soot and creosote buildup thereon, means positioned below said glass panel for redirecting said downwardly flowing curtain of hot air rearwardly to the base of a combustion region for maximizing combustion adjacent said glass panel so as to assist in maintaining the interior surface of said glass panel at an elevated temperature, and gas exit means located at the rear of said combustion chamber opposite said glass panel and systematically located at one-third to two-thirds of the distance from the bottom to the top of said combustion chamber, said gas exit means insuring that air and gases smoothly exit the combustion chamber without creating turbulence which reduces the uniformity of said curtain of hot air.

48. A heating apparatus as defined in claim 47 further including an ash pan assembly with a removable ash pan positioned below said combustion chamber for receiving ashes and preventing ash buildup which partially blocks the smooth flow of air through said combustion chamber.

49. A heating apparatus as defined in claim 47 wherein said gas exit means is symmetrically located with respect to said glass panel.

50. A method for cleaning transparent glass panels in a solid fuel burning stove comprising the steps of:

circulating clean external air through internal manifolds on opposite sides of a combustion chamber for preheating thereof;

passing the preheated air through a double manifold system above said glass panels to remove turbulence therefrom;

directing a uniform laminar curtain of hot air downwardly through an exit slot from said double manifold system and over said glass panels;

redirecting said curtain of hot air rearwardly from the bottom of said glass panels into the base of a combustion region for causing maximum combustion which further elevates the temperature of said glass panels; and exhausting air and gases from said combustion region through a gas exit located relatively high on the wall of said combustion chamber in a smooth flow to prevent turbulence which affects the uniformity of said curtain of hot air flowing over said glass panels.

51. A heating apparatus for burning solid fuel comprising:

a frame assembly defining a combustion chamber, said frame assembly including generally vertical front, side and rear walls, a top and a bottom;

a hinged door mounted in said front wall for pivoting about a vertical axis, said hinged door including a transparent glass panel to permit viewing of combustion in the combustion chamber; and glass panel means comprising means for preheating of external air including internal manifolds on opposite sides of said combustion chamber, means for receiving hot air from said preheating means and for producing a curtain of hot air flowing uniformly downward over interior surfaces of said transparent glass panel for maintaining said glass panel at an elevated interior temperature and for forming a barrier to prevent soot and creosote buildup thereon, means for redirecting said curtain of hot air rearwardly from the bottom of said glass panels into the base of a combustion region for causing maximum combustion which further elevates the temperature of said glass panels, and means for exhausting air and gases from said combustion region in a smooth flow to prevent turbulence which affects the uniformity of said curtain of hot air flowing over said glass panel.

* * * * *